US005339920A

United States Patent [19]

Eriksson

[11] Patent Number: 5,339,920

[45] Date of Patent: Aug. 23, 1994

[54] FOLDABLE FIRE-ESCAPE LADDER

[75] Inventor: Göran Eriksson, Karlstad, Sweden

[73] Assignee: Scandsam AB, Karlstad, Sweden

[21] Appl. No.: 678,354

[22] PCT Filed: Oct. 23, 1989

[86] PCT No.: PCT/EP89/01282

§ 371 Date: Apr. 24, 1991

§ 102(e) Date: Apr. 24, 1991

[87] PCT Pub. No.: WO90/05234

PCT Pub. Date: May 17, 1990

[30] Foreign Application Priority Data

Oct. 31, 1988 [SE] Sweden ..... 88039540
Oct. 31, 1988 [SE] Sweden ..... 88039557

[51] Int. Cl.[5] ..... E06C 9/12

[52] U.S. Cl. ..... 182/96; 182/160; 182/8

[58] Field of Search ..... 182/96, 160, 8, 95, 182/161, 159

[56] References Cited

U.S. PATENT DOCUMENTS 3,414,081 12/1968 Wedvik ..... 182/96 X
4,193,475 3/1980 Sweet et al. ..... 182/8
4,702,347 10/1987 Nilsen ..... 182/96 X

FOREIGN PATENT DOCUMENTS 2099059 12/1982 United Kingdom ..... 182/96

*Primary Examiner*—Alvin C. Chin-Shue
*Attorney, Agent, or Firm*—Griffin Butler Whisenhunt & Kurtossy

[57] ABSTRACT

The following invention relates to a fold out fire escape ladder. The ladder comprises at least two parallelly arranged strings (1, 2), which are interconnected by means of a plurality of pivotally arranged parallel rungs (3). The holes for the pivoting points (38) of each rung are arranged in off-centered positions, which positioning increases the strength of the ladder in a surprising manner. Furthermore the inner string (1) comprises mounting means (12), intended to co-operate with brackets (4), which substantially facilitate the attachment of a ladder.

9 Claims, 6 Drawing Sheets

FOLDABLE FIRE-ESCAPE LADDER

This invention relates to a foldable fire-escape ladder.

BACKGROUND OF THE INVENTION

Foldable escape ladders are well known. When used as fire-escape ladders they are attached to the wall of a building adjacent at least one window. When not in use it is folded, in such a manner that an intruder could not use the ladder. In this folded state it is hardly noticeable. By activating a release mechanism it is possible to bring the ladder into its unfolded state. It then presents a ladder having its rungs horizontally and substantially transversely outwardly directed from the wall.

Many existing buildings do not today have sufficient fire- escape facilities. Many larger buildings for instance have one or more fire exits on each floor leading to some kind o f stairway. Very often, however, fire causes panic-resulting in a jam at the fire exits. This is a reason why people are killed by fire.

Another major problem exists with houses having only one or two floors, since that kind of houses rarely are equipped with fire exits. The reason being high costs for conventional fire escape arrangements. This is another reason why many people die of fire.

The above-identified problem could possibly be solved by using the basic type of ladders previously described, since such a ladder in principal could be cheaply and aesthetically mounted to a building.

So far many have tried to present such a ladder but still not with the success that ought to be possible. The reason for this, probably being that known ladders all present some kind of functional deficiencies. From EP-A-0 230 502, for instance there is known such a foldable fire escape ladder, made of metal, comprising at least two parallelly arranged strings, one inner string and one outer string, which are interconnected by means of a plurality of parallel rungs of which the ends are pivotally connected to the respective strings; said inner string being substantially channel shaped having an intermediate portion co-joining two portions extending substantially parallelly and comprising means for interaction with mounting means; said outer string being channel shaped having an intermediate portion co-joining two portions extending substantially parallelly; each of said rung having a hollow cross-section being substantially rectangular and further having pivoting points, abutting end portions and chamfered end portions; wherein in the folded state at least the major part of the rungs are received within a space delimited by said strings and wherein in the unfolded state each said abutting end portion interact with the inner surface of intermediate portion of each respective string in such manner that the rungs are kept substantially perpendicularly in relation to the strings.

The above-identified known ladder has shown to have certain deficiencies, especially concerning strength. In order to meet certain requirements of firmness, this ladder presents rungs being relatively short, about 40 cm. The intention being to limit the maximum moment acting on the abutments and on the pivot-points. Furthermore, it has shown that the ladder after a long time of use, probably due to extreme pressure at the abutting ends of the rungs, can cause an exceeding play so that the stability of the unfolded ladder decreases.

SUMMARY OF THE INVENTION

Surprisingly, it has been found that these deficiencies could be solved by a ladder of the previously described kind wherein the pivoting-points of each rung are arranged in off-centered positions in relation to a plane parallel to each pivoting axis and which plane extends centrally alongside each respective rung and each rung having such pivoting-points placed on each side of said plane.

To arrange the pivot-points of the rungs in off-centered positions is previously known from several citations. None of these citations, however, teaches that such a measure could increase the strength and indeed in long term the stability of the ladder. It appears that the known citations would lead a skilled man in an opposite direction, away from this solution. As an example, both of the citations GB-A-2 099 059 and U.S. Pat. No. 3,575,263 teaches an off-centered positioning of the pivot-points, in order to make the ladder more compact in its folded state. Another citation U.S. Pat. No. 3,414,081 teaches this positioning of the pivot-points in order to provide a ladder which unfolds "by itself" (by gravity) when released. Still another one, GB-A-2 115 051, teaches this positioning of the pivot-points for a ladder acting the other way around, i.e. unfolding upwardly. Hence there is no teaching in prior art that would lead the skilled man to use off-centered pivot-points in order to increase the strength and long term stability of a folded ladder. Especially not for foldable ladders having rungs with hollow, closed cross sections, i.e. rectangular.

Another disadvantage with the ladder known from EP-A-0 230 502 is that it cannot be attached to all kinds of houses. The reason being that the brackets have to be positioned at the pivot-points of the rungs, i.e. the same bolt for the rung as for the bracket. Many walls, however, only present certain places where it is possible to attach the brackets. These possible attachment points rarely coincide at every place with a possible bracket attachment place of the ladder. Therefore the ladder cannot always be securely attached to the wall without cumbersome modifications and increased costs.

It is therefor a further object of the invention to provide a ladder having attachment means which eliminate the above-described deficiencies.

BRIEF DESCRIPTION OF THE DRAWINGS

The following is a more detailed description of an embodiment of the invention, reference being made to the accompanying drawings in which.

DETAILED DESCRIPTION OF SPECIFIC EMBODIMENT

Figure 1:
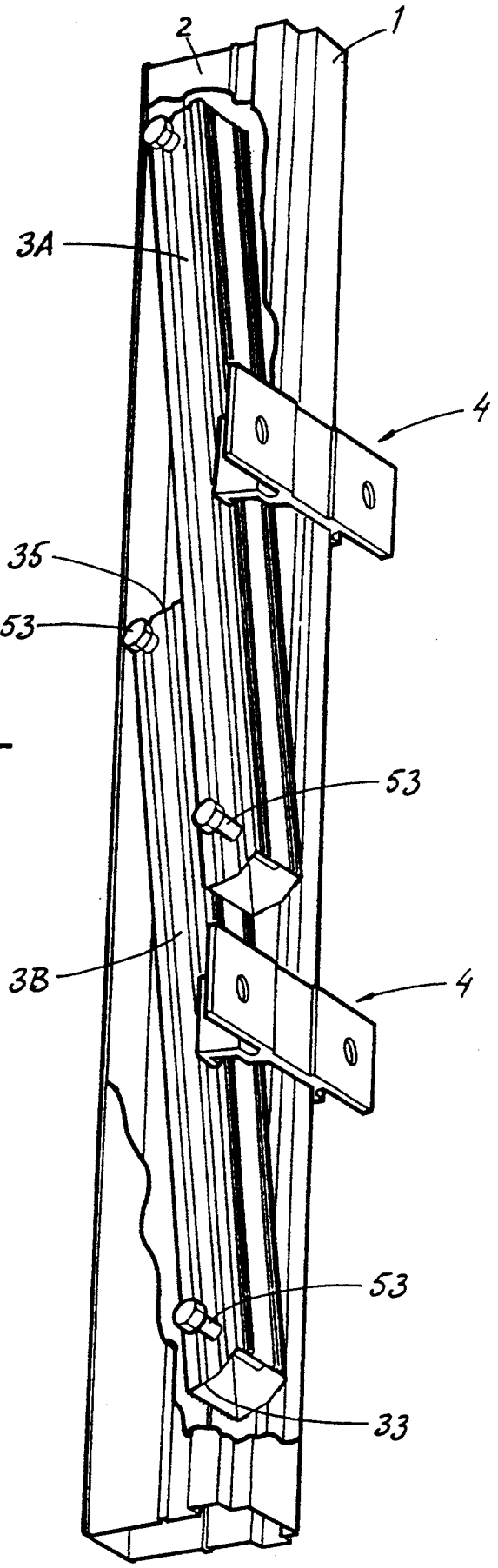
FIG. 1 is a perspective view of a part of the folded fire- escape ladder seen from underneath and from behind.

Referring to the drawings, the ladder comprises two elongate parallel strings 1 and 2, each having channel section form and made of metal. One of the strings 1, is securely mounted on a wall by means of brackets 4. Spaced apart along the length of the ladder are a plurality of parallel rungs 3, which are made of rectangular hollow metal sections.

Figure 5:
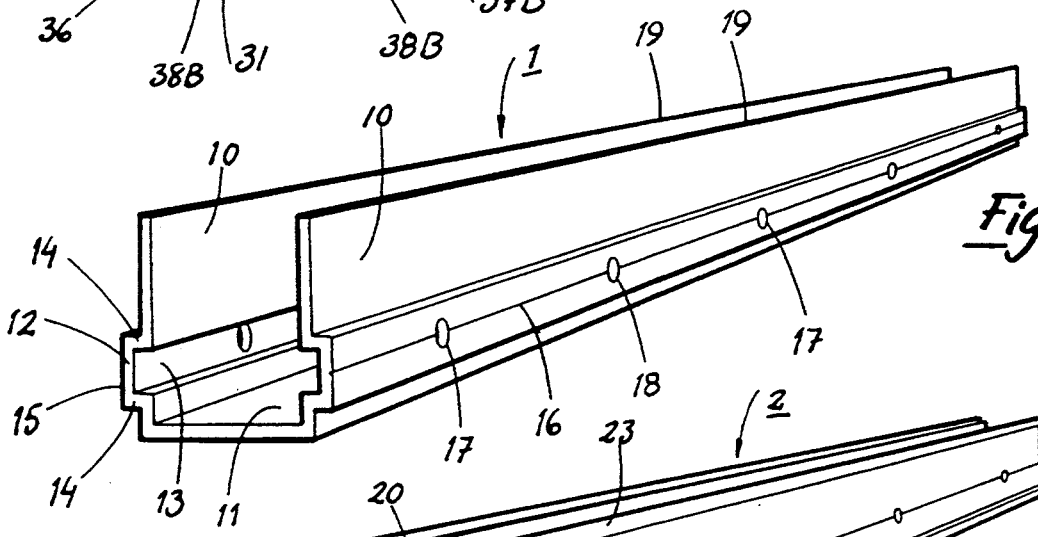
FIG. 5 is a perspective view of a part of an inner string.

As best seen in FIG. 5, the inner string 1 has two symmetrically formed leg like portions 10, which extend substantially parallel, and therebetween an intermedient portion 11 being substantially flat and non-curved. The inner distance between the leglike portions 10 generally corresponds to the width of the rung 3. Each leglike portion 10 has on a certain distance from the intermediate portion 11 a longitudinally extending protrusion 12 having an outwardly facing top surface 15 which is plane and parallel with the main plane of the leglike portions 10 and further having side portions 14 which are perpendicular to the leglike portions, i.e. parallel to the intermediate portion 11. In a corresponding manner, there exist on the inside of each leglike portion 10 a longitudinally extending channel 13 (groove). Centrally placed on the top surface 15 of the protrusion 12 there is a small groove 16. This groove 16 serves as the line for centering a number of holes 17 for mounting the rungs 3, which holes sometimes also can be used for mounting an attachment bracket 4. A second set of holes 18 are positioned on said line 16, which holes are intended for the attachment brackets 4. The position of these holes 18 depend on the structure of the building.

The channel 13 within the protrusion 12 has such dimensions so that the head 50 of the bolt (FIG. 4), which is to be used for mounting of the attachment brackets 4, can be totally emerged in the channel 13 and thereby be prevented from rotation. Accordingly, the height of the head 50 of the bolt is equal to or smaller than the depth of the channel 13. Furthermore the width of the channel 13 is somewhat smaller than the maximum width of the head 50 of the bolt. Preferably, the width of the channel 13 generally corresponds to the smallest width of the head 50 of the bolt.

Figure 4:
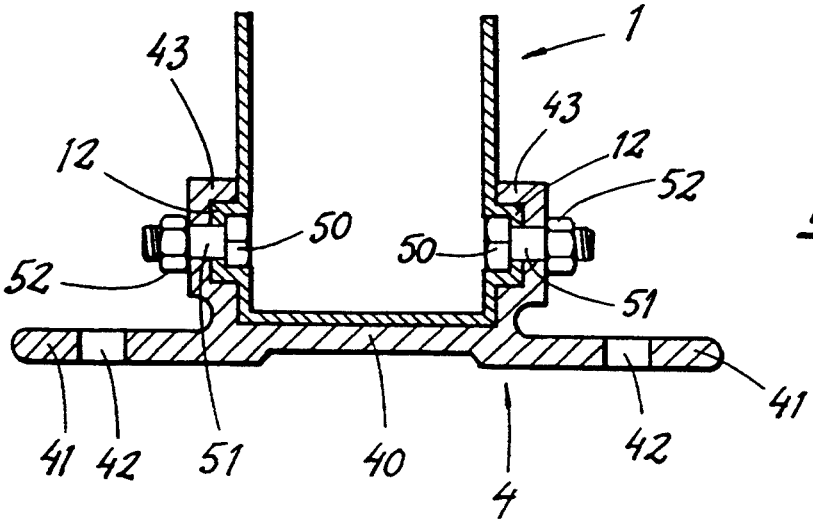
FIG. 4 is a horizontal cross section through the innermost string and one of its attachment brackets.

In FIG. 4 it is best shown how the bolt 51 extend through such a hole 18 and how an attachment bracket 4 is attached by means of it and a nut 52. This figure also shows that the bolt 51 mounted in this manner does not intrude on the string space within a string 1. Accordingly it is possible to mount the attachment brackets 4 anywhere along the spring without hindering the movement of the pivoting rungs 3.

Figure 6:
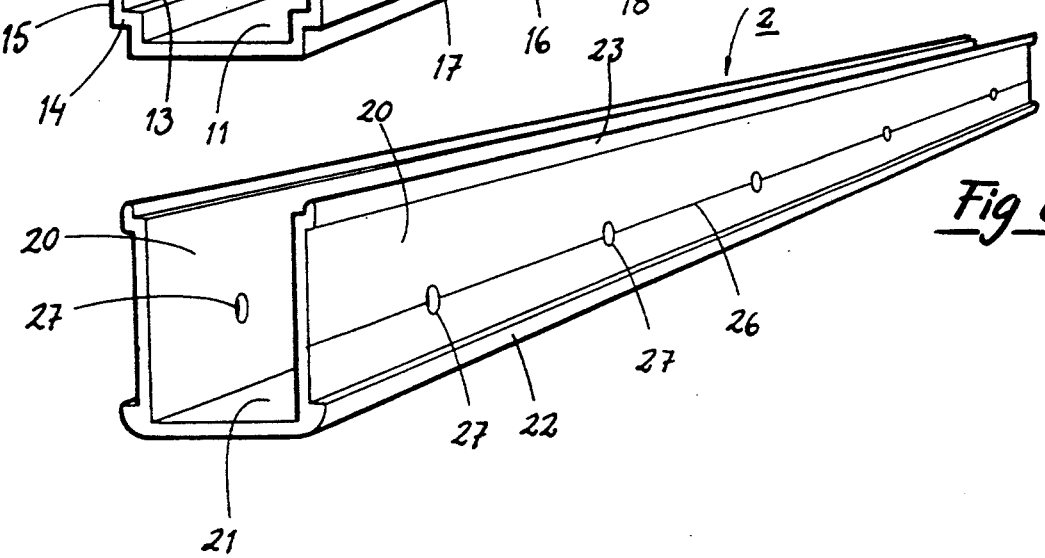
FIG. 6 is a perspective view of a part of an outer string.

In FIG. 6 the outer string 2 is best shown. The outer string 2 is also made of a channel beam, comprising two parallel leglike portions 20 and a generally straight intermediate portion 21. On the outerside of the transition areas between the intermediate portion 21 and the leglike portions 20 there are longitudinally extending protruding means 22 for co-operation with a sliding device of a safety harness. At the opposite ends of these leglike portions 20 there are arranged, as known per se, steering flanges 23, which are intended to cooperate with the outwardly extending surfaces of the leglike portions 10 of the inner string 1, in the folded state. Thereby the edge surfaces 19 of the inner string contact the inner surfaces of the leglike portions 20 of the outer string 2, adjacent the steering flanges 23. The leglike portions 20 have a number of holes 27, which correspond to the first holes 17 of the inner string 1. In a corresponding manner as with the top surface 15 of the protrusion 12 of the inner string 1, both of the leglike portions 20 are provided with a centering groove 26 for the holes 27. The groove 26 and therefore also the holes 27 are arranged at the same distance from the intermediate portion 21 as is the groove 16 from the intermediate portion 11 of the inner string 1.

Figure 7:
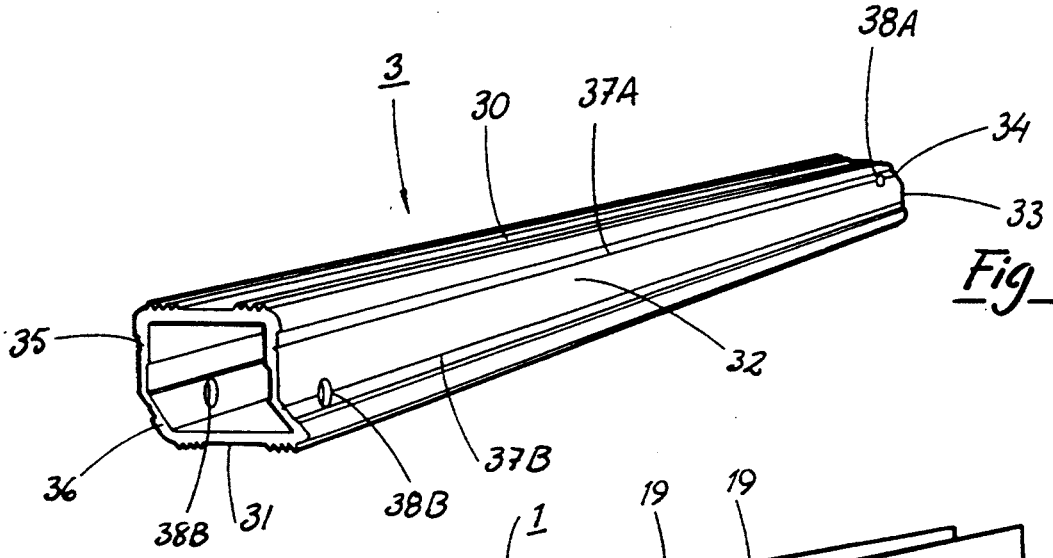
FIG. 7 is a perspective view of a rung.

FIG. 7 shows one rung 3. This rung 3 has a square cross section and has a milled upwardly facing surface 30 as well as a downwardly facing milled surface 31 and a pair of side surfaces 32. That end portion of the rung 3, which is to be pivotally attached to the inner string 1, has an abutting portion 33, which is perpendicular to the extension of the rung. This abutting portion 33 is at this end positioned adjacent the downwardly facing surface 31 of the rung 3. Further this end portion of the rung 3 has a chamfered portion 34 which extends between the abutting portion 33 and the upwardly facing surface 30.

That end part of the rung 3 which is mounted within the outer string 2 has a corresponding design, but is turned the other way around. Accordingly the perpendicular abutting portion 35 at this end is positioned adjacent the upwardly facing surface 30 of the rung, whereas the chamfered portion 36 is positioned adjacent the downwardly facing surface 31. On each side of the vertical slide surfaces 32 of the rung 3, there are one upper and one under longitudinally extending grooves 37A, 37B. The upper groove 37A is positioned adjacent the upwardly facing surface 30, i.e. between the upper surface 30 and an imaginary centrally placed line, whereas the-lower groove 37B is positioned between that imaginary line and the downwardly facing surface 31, so that these two grooves 37A and 37B are placed equally distanced from said central line and so that one of their ends meet a chamfered portion substantially in the middle thereof. Adjacent each chamfered end portion 34, 36 a hole 38A and 38B respectively is placed on the previously described groove 37A and 37B respectively, which holes 38A, 38B are equally distanced from its closest abutting end portion 33 and 35 respectively. Accordingly these holes 38A, 38B are symmetrically placed.

The different profiles of the inner stringer, outer stringer and rung 1, 2, 3 are made of extruded aluminum, which are anodized. The skilled man therefore realizes all that details such as the millings as well as all grooves, e.g. the centering grooves, are easily manufactured at the same time by this extrusion process. Therefore there is no extra work needed for making these centering grooves, which of course is time-saving. Compared to the known ladder EP-A-0 230 502 there is no longer any need for marking out the position of the holes in a transverse direction, in any of the profiles. Furthermore there is no need for counter-resisting the rotation of the bolt 51 when mounting the attachment brackets 4, at the same time as the bolt heads do not hinder the rungs as has been previously described.

Figure 3:
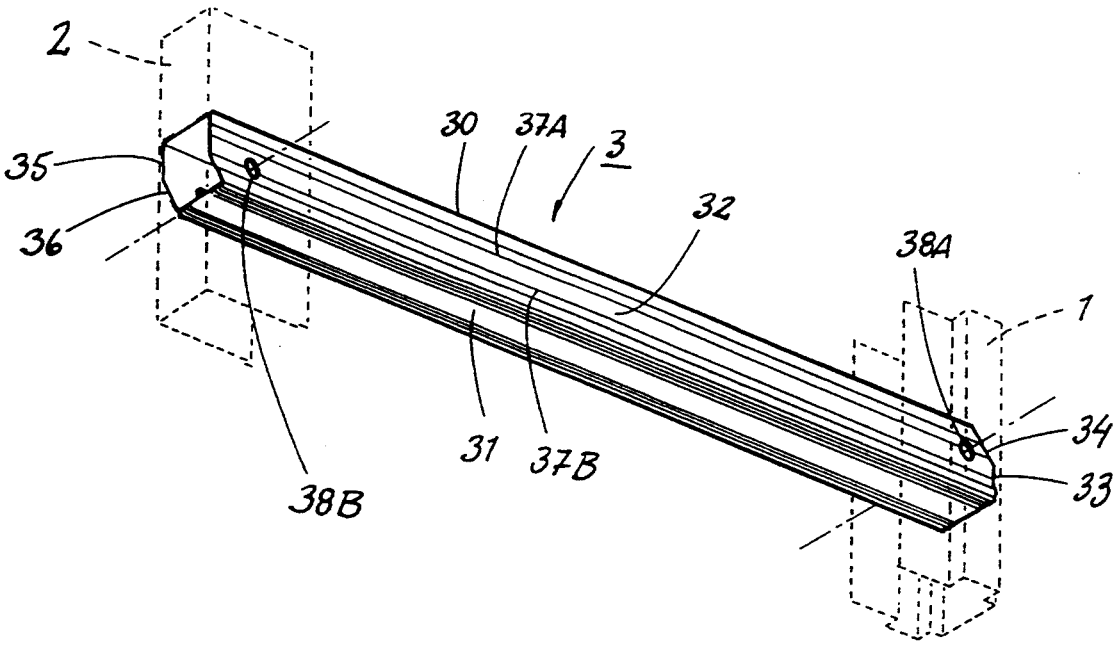
FIG. 3 shows a rung which is unfolded seen from above and from behind.
Figure 8:
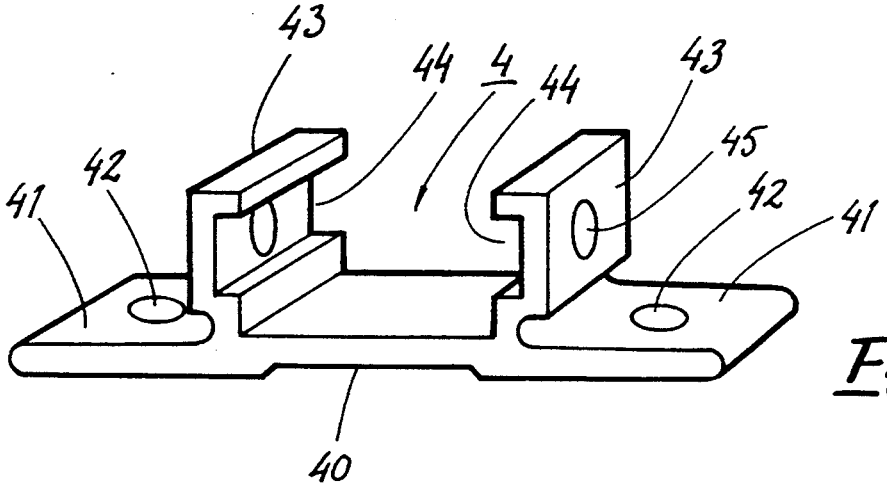
FIG. 8 is a perspective view of a bracket.

Referring now to FIG. 3, it is here best shown how the rung 3 interacts with the inner and outer strings 1 and 2, when the ladder is in its unfolded position. The abutting portions 35 and 33 are here in contact with the inner surface of each respective intermediate portion 11, 21. The position of each pivoting point, i.e. the bolts 51, the holes 38A and 17, etc, is such that each rung will be perpendicularly positioned in relation to the strings 1 and 2 when the abutting end portions 34 and 35 contact each respective intermediate portion 11, 21. Since the abutting end portions 33 and 35 extend perpendicularly in relation to the extension of the rung 3, each abutting end portion 33 and 35 will extend parallelly with its intermediate portion 11 and 21 respectively. This arrangement provides for a large contact surface at each abutting portion 33 and 35. The chamfered end portions 34 and 36 provide for the possibility to rotate the rungs about the pivoting points into a folded position, without contact between any part of said end portions and the strings 1, 2. In FIG. 3 the shown part of a ladder would be moved into its folded position by moving the outer string 2 upwardly substantially along the plane of the paper of FIG. 3.

In a comparative test (see table 1) between two ladders, being made of the substantially same profiles, it turned out that the positioning of the holes in accordance with the invention had a surprisingly large effect on the strength of the ladder. The test was made by applying load to the outer string 2 of each ladder (folded state). It should be noted that the ladder made in accordance with the invention, was 12.5% wider (50 wider, which makes it easier and safer to use) than the ladder made in accordance with what is shown in EP-A-0 230 502. In other words the ladder made in accordance with the invention had applied to it a moment being 12.5% higher. Still the ladder made in accordance with the invention withstood a force being 84% higher. Furthermore a ladder in accordance with the invention resisted downward movement in a corresponding manner. This is not only essential in relation to strength but also concerning its stability since the positioning of the abutting ends and the pivoting axis in relation to the strings are not optimal, once they start to be moved out of the intended position.

An attachment bracket 4 comprises a rear plate 40 and in the extension thereof a pair of attachment ears 41 having holes 42 for mounting the bracket 4 to the wall. A pair of gripping flanges 43 extend transversely out from the plate 40. Said gripping flanges comprise two other facing grooves 44 each having the same configuration as the outward side of the protrusions 12 of the inner string 1. Accordingly the outwardly extending portion of the bracket 4 has a configuration which corresponds to the configuration of the lower half of the inner string (the outside thereof). The flanges 43 have through holes 45, which are arranged at such a level so that these holes 45 can coincide with the holes 17 and 18 of the inner string, when the attachment bracket is threaded onto the inner string 1. In this position the attachment bracket will be guided by the protrusions 12 of the inner string 1.

Figure 2:
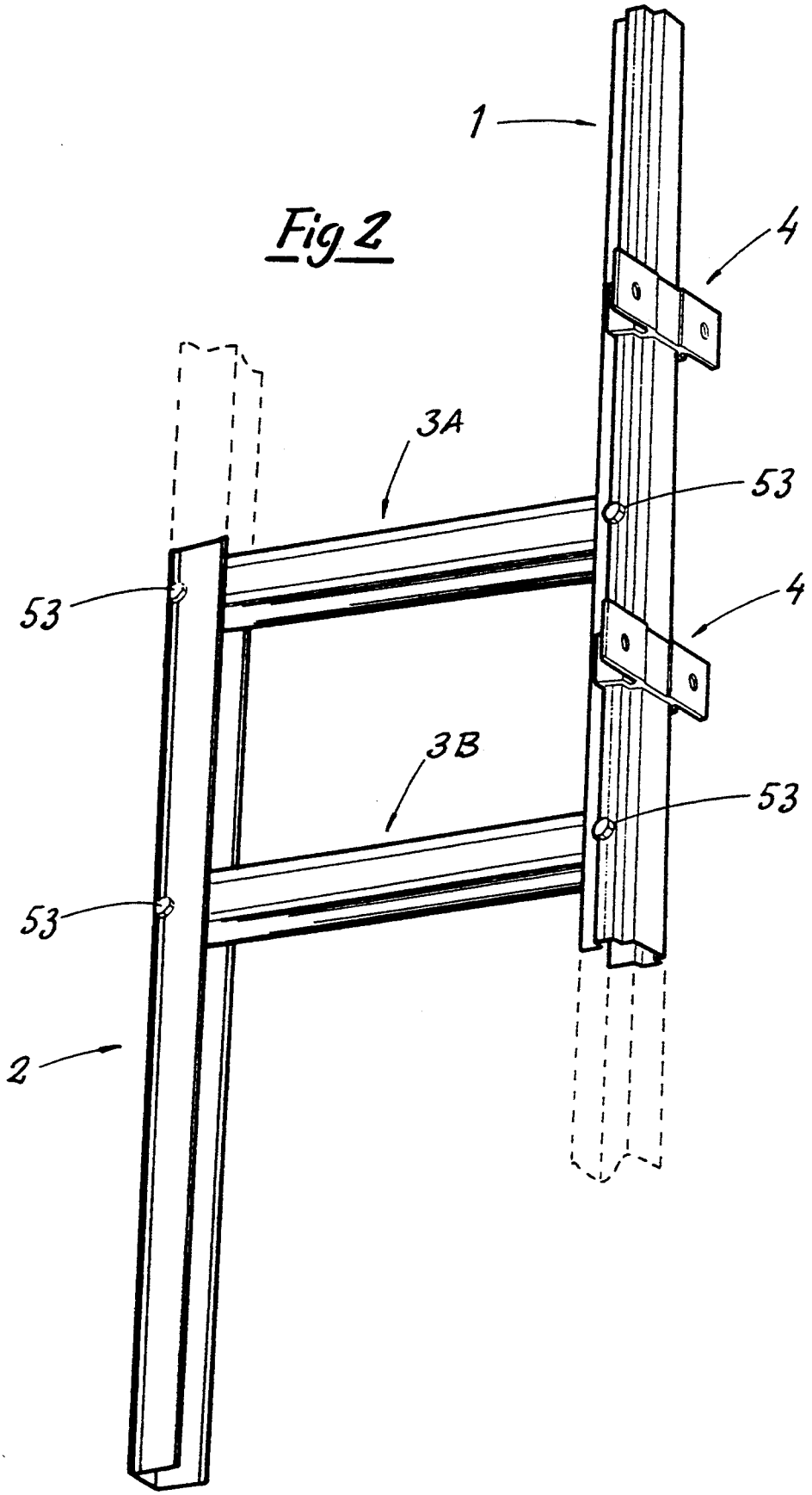
FIG. 2 shows the same ladder in its unfolded position.

If the attachment brackets can be mounted to coincide with the pivoting points of the rungs, it is possible to use a through passing bolt 53, as is shown in FIG. 2.

When mounted to a wall of a house having several stories it is connected in sections in a way that makes it possible to open it from each floor all the way down to the ground. An interconnecting device (not shown) is then put with its upperhalf in the lower end part of an outer string and with its lower part in upper end part of the adjacent lower outer string. A releasing pin which passes through said interconnecting device and through one of the strings keeps the two ends of the adjacent strings together. When the releasing pin is pulled the ladder unfolds under its own weight all the way down from that place where the pin was pulled. Accordingly the ladder cannot be opened from below and therefore fulfills the requirements on safety against intruders. Wall brackets have to be mounted approximately every one and a half meters. There are special brackets for negotiating minor wall protuberances. Balconies etc can be by passed with special ladder sections. In the folded mode the ladder only presents a 50 mm strip appearing on the wall.

By providing the ladder with a lock pin at the bottom it becomes an excellent inspection/working ladder for example to be used by chimney sweepers or service workers industry. Such a ladder could also be equipped with a lock, so that only authorized people could use it.

An added protection is the safety belt. Prior to mounting the belt it is fastened around the waist and the glider-lock hooked onto the outer string 2. If a normal descent, the glider-lock will follow downwards. However, if a person looses the foot hold e.g. slips or faints the glider will lock instantly, thus preventing a fall. A preferred safetybelt can be attached anywhere along the length of the ladder.

Figure 9:
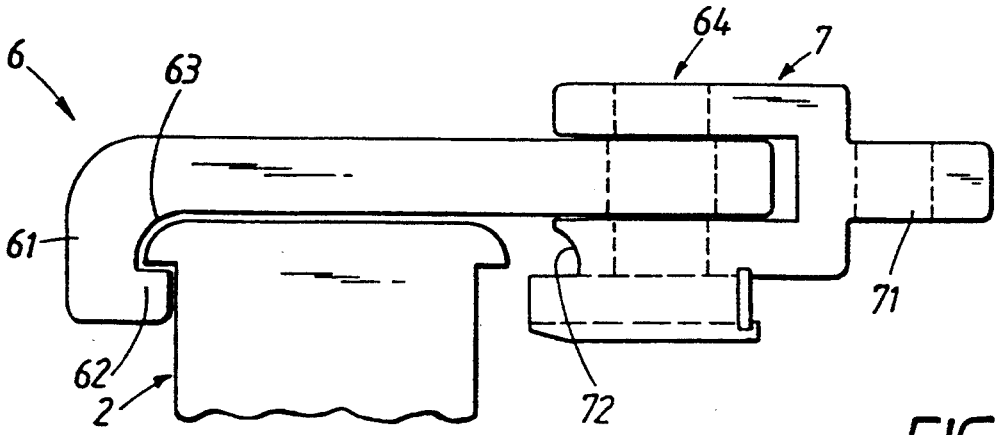
FIG. 9 is a horizontal view of a ladder having a glider-lock hooked onto the outer string.

In FIG. 9 there is shown a glider-lock of a first preferred type which has been snapped onto an outer string 2. The glider-lock has a glider body 61 which at its curved end has an inwardly protruding flange portion 62. This flange portion 62 interacts with one of the flange portions 22 of the outer string 2. Adjacent said flange portion 62 the glider body 61 is provided with an inner portion 63 which is smoothly curved substantially in accordance with the corresponding curvature of the outer string (e.g. r=5–7 mm). This is a feature that facilitates the mounting, snapping onto, of the glider-lock 6. Previously known glider-locks has sharp bending corners at this place, which makes the mounting of a glider-lock 6 complicated.

Pivotally mounted about an axis 64 there is arranged a braking means 7. This braking means 7 has a hole 71 via which it is possible to interconnect the glider-lock 6 with a safety harness (not shown). The braking-means 7 further has a curved inwardly directed surface 72 which is intended to co-operate with one of the outer surfaces of the outer string 2 in order to create a braking action when pressed against it.

Figure 10:
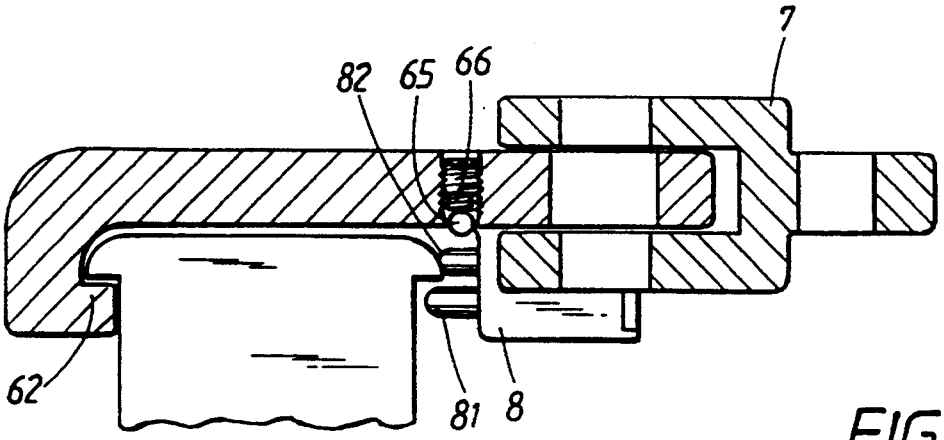
FIG. 10 is a horizontal cross section through the middle of a preferred glider-lock, and, FIG. 11 is a front view of a preferred glider-lock.

FIG. 10 shows a second preferred mode of example of a glider-lock. One of two special units 8 for the snapping-in of the glider-lock is clearly shown here. Such a device 8 comprises two spring actioned inwardly directed pins 81, 82. One of these pins 81 has as its main function to keep the glider-lock 6 secured to the flange portions 22 of the outer string 2. The other pin 82 has as its main function to keep the glider-lock steady during sliding. It acts with a resilient force on the flange portion 22 of the outer string 2 in order to avoid rattling of the glider-lock 6 during movement thereof. The spring force urging the second pin 82 is larger than the spring force for the first pin 81. This provides for a safety arrangement, i.e. the glider-lock 6 cannot be of hooked without using a substantial force; since the second pin (82) has to be depressed before the glider-lock 6 can be taken off the outer string 2.

Furthermore, FIG. 10 shows that the glider-lock has a spring urged ball 65 in a hole 66 of the body portion 61. This spring actioned ball 65 hinders the braking means 7 from being moved into the braking position without applying a certain force.

Figure 11:
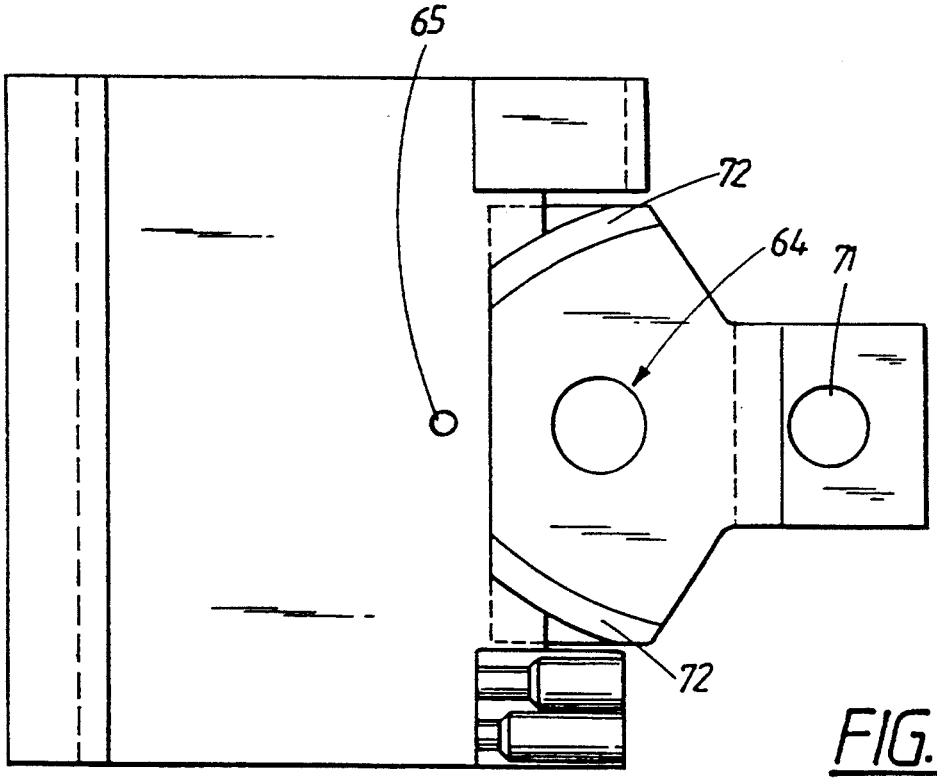

In FIG. 11 it is more clearly shown how the curved portions 72 of the braking means are designed and that the braking means 7 has to depress the ball 65 before it can be moved into the braking position. The pins 81, 82, however, are not mounted in this shown figure. As has been already described the glider-lock 6 is mounted onto the outer string 2 by a snapping-in action. The snapping-in being caused by the two symmetrically placed first pins 81. During sliding of the glider-lock-6 the two second pins 82, also symmetrically placed, provide for a stable movement thereof.

The invention is not delimited by the above described preferred mode of examples but may be varied within the scope of the claims. It would be possible, for instance, not to produce the centering grooves during the extrusion process, but having some kind of fixture for cutting the extruded profiles into desired lengths, and drilling the holes. Furthermore it should be understood that also other kind of materials could be used to produce the ladder such as other metals (e.g. magnesia) and fibre composite materials.

It should be realized that this glider-lock could also be used as a separate-unit, i.e. not only together with this kind of a ladder.

TABLE 1

| | A ladder in accordance with EP-A-0 230 502 Variation of the level of the outer string (mm) | | A ladder in accordance with the invention Variation of the level of the outer string (mm) | |
|---|---|---|---|---|
| Load (kp) | Loaded | Unloaded | Loaded | Unloaded |
| 100 | 3,5 | 1,0 | 5,0 | 0,5 |
| 200 | 5,5 | 2,0 | 8,0 | 1,0 |
| 300 | 6,0 | 2,5 | 9,5 | 1,0 |
| 400 | 7,5 | 3,0 | 11,0 | 1,0 |
| 500 | 9,0 | 3,5 | 12,5 | 1,0 |
| 600 | 10,5 | 4,0 | 14,0 | 2,5 |
| 700 | 11,5 | 4,0 | 15,5 | 2,5 |
| 800 | 13,0 | 4,5 | 17,0 | 3,5 |
| 900 | 15,0 | 5,0 | 18,0 | 4,0 |
| 1000 | 17,0 | 6,0 | 20.0 | 5.5 |
| 1100 | 20,0 | 8,0 | 21,0 | 6,0 |
| 1200 | 22,5 | 9,5 | 22,5 | 7,5 |
| 1300 | 26,0 | 12,0 | 24,0 | 8,0 |
| 1400 | 31,0 | 13,5 | 25,5 | 9,0 |
| 1500 | 39,5 | 22,0 | 27,0 | 11,0 |
| 1600 | 60,0 | 40,5 | 29,0 | 13,0 |
| 1700 | | | 31,0 | 14,0 |
| 1800 | | | 34,0 | 17,0 |
| 1900 | | | 37,0 | 19,5 |
| 2000 | | | 38,5 | 20,5 |
| 2100 | | | 41,5 | 23,0 |
| 2200 | | | 45,0 | 26,0 |
| 2300 | | | 49,0 | 29,5 |
| 2400 | | | 53,0 | 33,0 |
| 2500 | | | 57,5 | 36,5 |
| 2600 | | | 63,0 | 41,5 |
| 2700 | | | 69,0 | 47,0 |
| 2800 | | | 76,0 | 53,5 |
| 2900 | | | 84,5 | 61,5 |
| 2950 | | | 91,5 | 65,0 |

I claim:

1. In a metal fire escape ladder comprising at least an inner string and an outer string, which strings are parallel and interconnected by means of a plurality of parallel rungs having ends pivotally connected to the respective strings; said inner string being substantially channel shaped and having an intermediate portion co-joining two substantially parallel portions having interacting means for interaction with mounting means of said ladder; said outer string being channel shaped and having an intermediate portion co-joining two substantially parallel portions; each said rungs having a hollow, substantially rectangular cross-section, a varying cross-sectional wall-thickness and further having pivoting points, chamfered abutting end portions; wherein in a folded state at least a major part of the rungs are received within a space defined by said strings and wherein in an unfolded state each said abutting end portion interacts with an inner surface of said intermediate portion of each respective string in such manner that the rungs are kept substantially perpendicular to the strings, the improvement wherein said pivoting-points of each rung are arranged in off-centered positions in relation to a plane parallel to pivoting axis of each, which plane extends centrally along each respective rung, and each rung having the pivoting-points disposed on each side of said plane, and wherein each sections of each rung near said abutting end portions having the pivoting-points therein generally has a greater cross-sectional wall-thickness than the a wall-thickness of an intermediate section between the end sections, which intermediate section is substantially centrally located along each rung, and wherein said interacting means, at the same level on each side of the inner string, has an outwardly protruding longitudinally extending portion with a U-shaped cross-section such that an inner groove is formed therein.

2. Fire-escape ladder according to claim 1, wherein inner string holes for the pivoting-points of the inner string are centrally placed on said interacting means.

3. Fire-escape ladder according to claim 2, wherein outer string holes for the pivoting points of the outer string are positioned at the same distance from the inner surface of the intermediate portion as are the inner string holes of the inner string in relation to the inner surface of the intermediate portion.

4. Fire-escape ladder according to claim 1, wherein sides of each rung are arranged with one upper and one under longitudinally extending centering groove, for centering of upper and under rung holes.

5. Fire-escape ladder according to claim 1, wherein the depth of the inner groove of the interacting means is equal to or larger than a thickness of a head of a bolt being passing through the inner holes.

6. Fire-escape ladder according to claim 5, wherein the width of the inner groove of the interacting means is smaller than the maximum width of the head of the bolt.

7. Fire-escape ladder according to claim 1, wherein said mounting means is a bracket having innermost surfaces which are configured to correspond to an outer surface of the interacting portions.

8. Fire-escape ladder according to claim 1, wherein said outer string has protrusion means for interaction with a glider-lock and said glider-lock has a smoothly curved portion between an outer gripping flange and a longitudinally extending main portion.

9. Fire-escape ladder according to claim 8, wherein said glider-lock comprises a braking means which is pivotally arranged thereto, which braking means has a surface which corresponds to a surface of the outer string upon which the braking means may bear with a force when pivoted a set distance.

* * * * *